US009900715B2

(12) United States Patent
Andersen

(10) Patent No.: US 9,900,715 B2
(45) Date of Patent: Feb. 20, 2018

(54) METHOD AND SYSTEM FOR ESTIMATING ACOUSTIC NOISE LEVELS

(71) Applicant: GN Audio A/S, Ballerup (DK)

(72) Inventor: Michael Hoby Andersen, Ballerup (DK)

(73) Assignee: GN Audio A/S (DK)

( * ) Notice: Subject to any disclaimer, the term of this patent is extended or adjusted under 35 U.S.C. 154(b) by 184 days.

(21) Appl. No.: 14/518,190

(22) Filed: Oct. 20, 2014

(65) Prior Publication Data

US 2015/0110278 A1 Apr. 23, 2015

(30) Foreign Application Priority Data

Oct. 21, 2013 (EP) ..... 13189557

(51) Int. Cl.
*H04R 29/00* (2006.01)
*H04R 25/00* (2006.01)

(52) U.S. Cl.
CPC ..... *H04R 29/00* (2013.01); *H04R 25/407* (2013.01)

(58) Field of Classification Search
CPC ..... H04R 29/00; H04R 25/407; H04R 29/008
(Continued)

(56) References Cited

U.S. PATENT DOCUMENTS

2002/0097882 A1 7/2002 Greenberg et al.
2010/0135502 A1* 6/2010 Keady ..... A61B 5/121 381/58
2014/0046659 A1* 2/2014 Burton ..... G06Q 10/10 704/226

FOREIGN PATENT DOCUMENTS

JP H07 318412 12/1995
JP 2006058245 3/2006
WO 2009/006897 1/2009

OTHER PUBLICATIONS

Oct. 2012, SoundEar PRO brochure; SoundEar A/S, Skudehavnsvej 5, DK-2100 Copenhagen, Denmark; www.soundear.com.
(Continued)

*Primary Examiner* — Vivian Chin
*Assistant Examiner* — Douglas Suthers
(74) *Attorney, Agent, or Firm* — Altera Law Group, LLC

(57) ABSTRACT

The present invention relates to a method and a system for estimating acoustic noise levels. The invention may advantageously be applied in systems comprising multiple audio communication devices, such as e.g. telephones, mobile phones, headsets and headset base stations.

It is an object of the present invention to provide respectively a method for estimating acoustic noise levels and a system for estimating acoustic noise levels, which enable a more efficient use of resources and may reduce cluttering in offices and other working environments than the prior art.

This and other objects are achieved by a method for estimating acoustic noise levels, the method comprising: (66) for each of two or more audio communication devices (1, 21, 31), receiving an acoustic signal (61) from ambient space (62) and providing a corresponding microphone output signal (63) by a microphone (5, 7, 23) comprised by the respective audio communication device (1, 21, 31) and (67) repeatedly estimating a local acoustic noise level (64) in dependence on the microphone output signal (63); and (68) repeatedly estimating a location-dependent distribution of acoustic noise levels in ambient space (65) in dependence on the local acoustic noise levels (64).

13 Claims, 8 Drawing Sheets

(58) Field of Classification Search
USPC ..... 381/56, 334, 72
See application file for complete search history.

(56) References Cited

OTHER PUBLICATIONS

Oct. 2012, SoundEarV brochure; SoundEar A/S, Skudehavnsvej 5, DK-2100 Copenhagen, Denmark; www.soundear.com.
European Search Report for European application No. 13189557.5 dated Jan. 20, 2014.
Office Action dated Feb. 10, 2016 for European Patent application No. 13189557.5.

* cited by examiner

METHOD AND SYSTEM FOR ESTIMATING ACOUSTIC NOISE LEVELS

TECHNICAL FIELD

The present invention relates to a method and a system for estimating acoustic noise levels. The invention may advantageously be applied in systems comprising multiple audio communication devices, such as e.g. telephones, mobile phones, headsets and headset base stations.

BACKGROUND ART

A noise indication system, "SoundEar®", is known that may be set up with multiple microphone units distributed in a room or a suite of rooms, such as e.g. an open office or a workshop, and one or more display units located in the same room or suite of rooms. Each microphone unit measures acoustic noise levels at its location and transmits the measured acoustic noise levels to one or more of the display units, which display the current noise level in a symbolic fashion. The noise indication system gives visual feedback about the noise levels, thereby making office and workshop workers aware of their own noise contribution, which may generally aid in lowering the overall noise level. Ideally, each office desk or work location should be equipped with a microphone unit. In larger rooms with many workers, the microphone units may thus make the noise indication system rather expensive, and they may further contribute to cluttering of desktops and workbenches.

Headsets for use with telephone networks and other audio communication networks have been known for many years, and they typically comprise a microphone for picking up the wearer's voice as well as one or two earphones for providing acoustic output signals to one or both of the wearer's ears. Audio signals output by the microphone are typically amplified in a switch board or a base station connected between the headset and the telephone system and the amplified signals are provided to a telephone line of the telephone system. The switch board or base station may also amplify audio signals received from the telephone line before providing them to the headset earphone or earphones. Some known telephone systems allow interconnecting more than two parties in a so-called conference call so that one or more of the parties can receive audio signals from multiple other parties.

DISCLOSURE OF INVENTION

It is an object of the present invention to provide respectively a method for estimating acoustic noise levels and a system for estimating acoustic noise levels, which enable a more efficient use of resources and may reduce cluttering in offices and other working environments.

This and other objects of the invention are achieved by the invention defined in the independent claims and further explained in the following description. Further objects of the invention are achieved by embodiments defined in the dependent claims and in the detailed description of the invention.

Within this document, the term "audio communication network" refers to a network that allows two or more users (parties) to communicate orally with each other by electronic means. The term "audio communication device" refers to a device that may be connected directly or indirectly to an audio communication network and that comprises one or more acoustic transducers adapted to pick up a user's voice and/or provide one or more acoustic signals to the user, such that the user may use the audio communication device as an interface for communicating orally via the audio communication network. The term "headset" refers to an audio communication device adapted to be worn on a user's head. Furthermore, when an element or entity is referred to as being "connected" or "coupled" to another element or entity, this includes direct connection (or coupling) as well as connection (or coupling) via intervening elements or entities, unless expressly stated otherwise. Also, unless expressly stated otherwise, when a signal is referred to as being "provided" by a first entity to a second entity, this includes directly or indirectly transmitting the signal in its original form as well as any direct or indirect transmission that modifies the original signal and/or converts the signal into another domain and/or representation before it arrives at the second entity, provided that the information comprised by the signal received by the second entity is sufficient for the second entity to perform the specified actions with respect to the signal.

Within this document, the singular forms "a", "an", and "the" are intended to include the plural forms as well (i.e. to have the meaning "at least one"), unless expressly stated otherwise. Correspondingly, the terms "has", "includes", "comprises", "having", "including" and "comprising" specify the presence of respective features, operations, elements and/or components, but do not preclude the presence or addition of further entities. The term "and/or" generally includes any and all combinations of one or more of the associated items. The steps or operations of any method disclosed herein need not be performed in the exact order disclosed, unless expressly stated otherwise.

BRIEF DESCRIPTION OF THE DRAWINGS

The invention will be explained in more detail below in connection with preferred embodiments and with reference to the drawings in which.

The figures are schematic and simplified for clarity, and they just show details essential to understanding the invention, while other details may be left out. Where practical, like reference numerals and/or names are used for identical or corresponding parts.

MODE(S) FOR CARRYING OUT THE INVENTION

Figure 1:
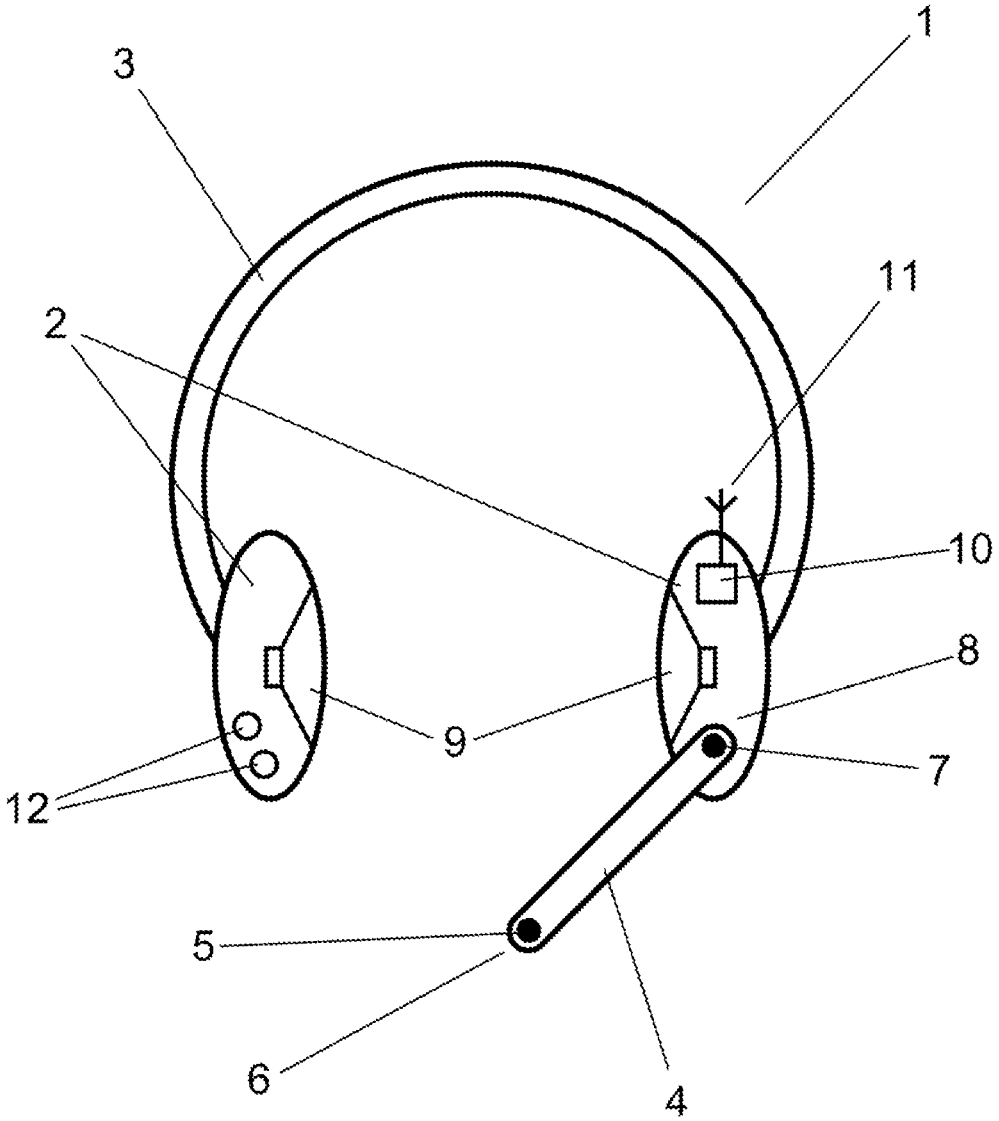
FIG. 1 shows an embodiment of a headset, which may be used or comprised by embodiments of the invention.

The headset 1 shown in FIG. 1 comprises two earphones 2, a headband 3 mechanically and electrically connecting the earphones 2 and a microphone arm 4 pivotably attached to one of the earphones 2. The microphone arm 4 comprises a voice microphone 5 at a distal end 6 of the microphone arm 4 and a noise microphone 7 at a proximal end 8 of the microphone arm 4. Each earphone 2 comprises a driver 9 for providing an acoustic output signal to the respective ear of the wearer of the headset 1. The earphone 2 with the microphone arm 4 further comprises a signal processing unit 10 and an interface unit 11 for connecting the headset 1 to an audio communication network 30 (see FIG. 3), either directly or e.g. via a base station 21 (see FIG. 2). The other earphone 2 comprises two user-operable control elements 12, such as e.g. mechanical switches or capacitive sensors, allowing the wearer to e.g. switch on and off the headset 1, the voice microphone 5 and/or the noise microphone 7 and control the loudness of the acoustic output signals.

The voice microphone 5 is arranged to receive an acoustic signal and adapted to provide a voice microphone output signal in dependence on the received acoustic signal. The voice microphone 5 is preferably arranged such that it is located close to the wearer's mouth, e.g. within a distance of 2-4 cm of the mouth, when the headset 1 is worn and it may thus pick up mainly the wearer's voice when he or she is speaking. The voice microphone 5 preferably has a directional characteristic which emphasizes signals from the wearer's mouth. Nevertheless, the voice microphone 5 may pick up an acoustic signal from ambient space as well, e.g. in speech pauses. The noise microphone 7 is arranged to receive an acoustic signal and adapted to provide a noise microphone output signal in dependence on the received acoustic signal. The noise microphone 7 is preferably arranged such that it is located further away from the wearer's mouth than the voice microphone 5, e.g. within a distance of 8-20 cm of the mouth, when the headset 1 is worn. The noise microphone 7 preferably has a directional characteristic which suppresses signals from the wearer's mouth. The noise microphone 7 may thus pick up acoustic signals mainly from ambient space, even when the wearer is speaking. Any or each of the voice microphone 5 and the noise microphone 7 may optionally comprise several microphone units and/or several microphone inlets that are connected as already known in the art, e.g. to provide a desired directional characteristic.

The signal processing unit 10 is connected to receive the voice and noise microphone output signals from respectively the voice microphone 5 and the noise microphone 7 and is adapted to provide a voice audio signal via the interface unit 11 to the audio communication network 30 in dependence on the microphone output signals. The signal processing unit 10 may e.g. use the output signal from the noise microphone 7 to reduce noise in the output signal from the voice microphone 5, such that the voice audio signal comprises a noise-reduced representation of the wearer's voice. The signal processing unit 10 is further connected to receive an earphone audio signal from the audio communication network 30 via the interface unit 11 and to provide a drive signal to each of the drivers 9 in dependence on the earphone audio signal. The signal processing unit 10 may further be adapted to provide status messages, such as e.g. battery charge level and/or control commands in response to operation of the control elements 12 to the base station 21 and/or the audio communication network 30 via the interface unit 11. The earphones 2, the headband 3 and the microphone arm 4 preferably comprise electric leads (not shown) for electrically connecting the signal processing unit 10 with respectively the microphones 5, 7, the drivers 9 and the control elements 12.

The interface unit 11 may comprise e.g. a cable with a phone plug (not shown), e.g. a 3.5 mm TRS phone connector, or a USB plug at the distal end for electrically connecting the signal processing unit 10 to the base station 21 or the audio communication network 30. Alternatively, the interface unit 11 may comprise a radio transceiver (not shown), such as e.g. a Bluetooth transceiver, a DECT transceiver or a Wi-Fi transceiver, or an optical transceiver for wirelessly connecting the signal processing unit 10 to the base station 21 or the audio communication network 30. The interface unit 11 may be adapted to establish a party connection with the audio communication network 30.

In some embodiments, the headset 1 may comprise only one earphone 2, and in such embodiments, the headset 1 may optionally be worn at, on or in the wearer's ear. In some embodiments, the noise microphone 7 may be absent. In some embodiments, the headband 3 may be replaced with another type of wearing device, such as e.g. an earhook or a neckband. In some embodiments, the two earphones 2 of the headset 1 may communicate wirelessly with each other. In some embodiments, the control elements 12 may be absent or arranged on or in another part of the headset 1. In some embodiments, the signal processing unit 10 may be arranged on or in another part of the headset 1. In some embodiments, the signal processing unit 10 may be absent and the earphone or earphones 2 and the microphone 5 or microphones 5, 7 be connected directly to the interface unit 11. In some embodiments, the interface unit 11 may be arranged on or in another part of the headset 1. In some embodiments, the microphone arm 4 may be absent and the microphone 5 or microphones 5, 7 arranged on or in another part of the headset 1.

Figure 2:
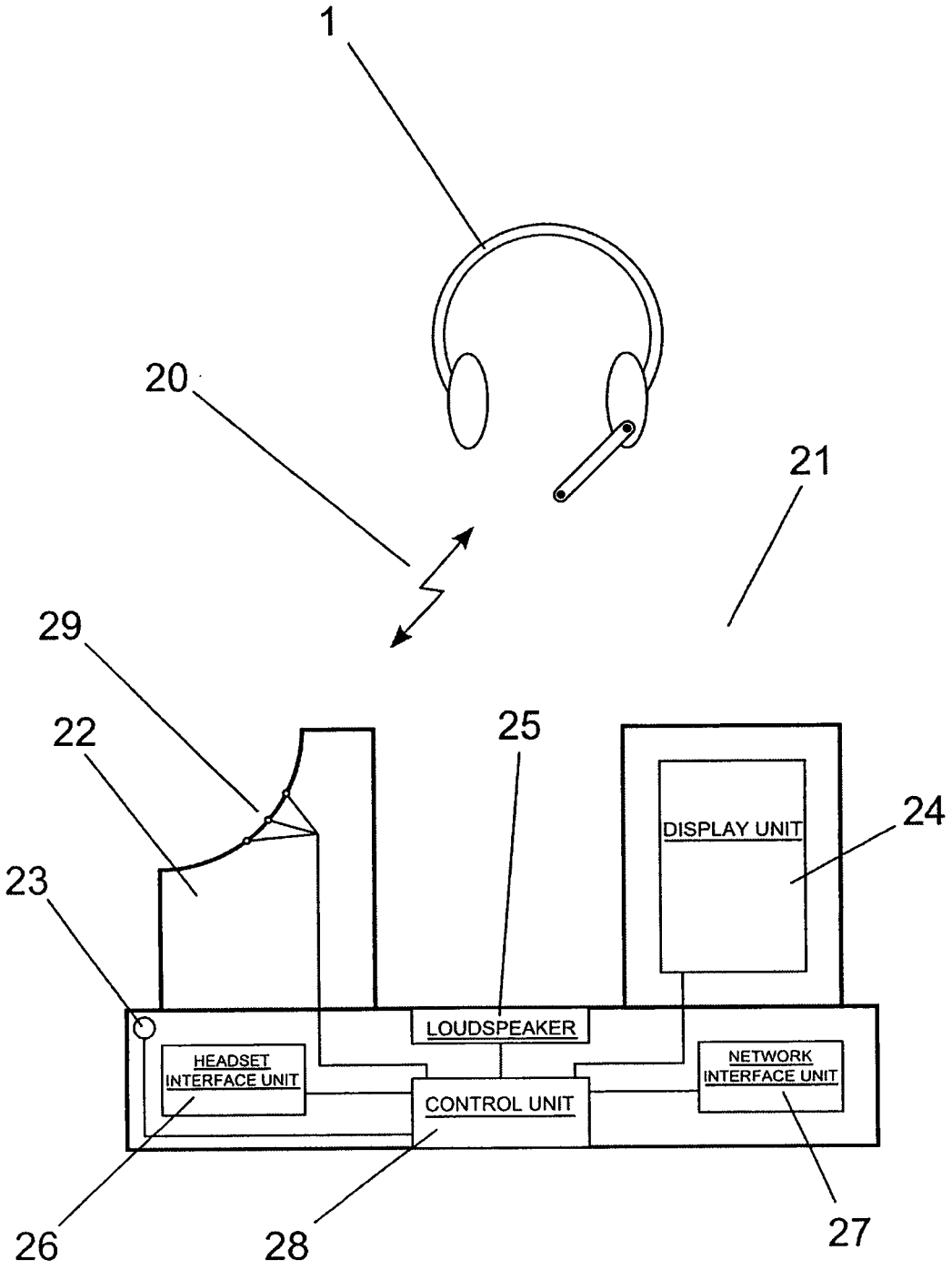
FIG. 2 shows an embodiment of an audio communication device comprising a headset and a base station, which may be used or comprised by embodiments of the invention.

The audio communication device shown in FIG. 2 comprises a headset 1 as shown in FIG. 1 and described above as well as a base station 21 comprising a cradle 22 for docking the headset 1, a base microphone 23, a display unit 24, a loudspeaker 25, a headset interface unit 26 for connecting the base station 21 to the headset 1, a network interface unit 27 for connecting the base station 21 to an audio communication network 30, and a control unit 28. A portion of the cradle 22 may have a shape adapted to abut a surface of the headset 1, such that the headset 1 may rest on the cradle 22 when not in use. The cradle 22 may further comprise electrical connectors 29 for providing e.g. a charging current from the control unit 28 to the headset 1 and/or communication signals between the control unit 28 and the headset 1 when the latter is docked in the cradle 22. The base microphone 23 is arranged to pick up an acoustic signal from ambient space and adapted to provide a corresponding base microphone signal to the control unit 28. The display unit 24 comprises a touch screen for displaying messages from the control unit 28 and receiving user input to the control unit 28. The loudspeaker 25 is arranged to emit an acoustic output signal to ambient space in dependence on an audio output signal received from the control unit 28.

The headset interface unit 26 may comprise e.g. a phone plug receptacle (not shown), e.g. a 3.5 mm TRS phone socket, or a USB socket for electrically connecting the control unit 28 to the headset 1. Alternatively, the headset interface unit 26 may comprise a radio transceiver (not shown), such as e.g. a Bluetooth transceiver, a DECT transceiver or a Wi-Fi transceiver, or an optical transceiver for wirelessly connecting the control unit 28 to the headset 1 via a wireless connection 20. The network interface unit 27 may comprise e.g. a cable with a phone plug (not shown) or a USB plug for electrically connecting the control unit 28 to the audio communication network 30. Alternatively, the network interface unit 27 may comprise a radio transceiver (not shown), such as e.g. a Bluetooth transceiver, a DECT transceiver or a Wi-Fi transceiver, or an optical transceiver for wirelessly connecting the control unit 28 to the audio communication network 30. The network interface unit 27 may be adapted to establish a party connection with the audio communication network 30.

The base station 21 may be adapted to serve as an interface between the headset 1 and the audio communication network 30, and the control unit 28 may be adapted to receive a voice audio signal from the headset 1 and to provide it to the audio communication network 30 via the party connection as well as to receive an earphone audio signal from the audio communication network 30 via the party connection and to provide the earphone audio signal to the headset 1. The control unit 28 may be adapted to modify the voice audio signal and/or the earphone audio output signal in any known way before forwarding the signals to respectively the audio communication network 30 and the headset 1.

Alternatively, or additionally, the control unit 28 may be adapted to receive the base microphone signal from the base microphone 23 and to provide a voice audio signal to the audio communication network 30 in dependence on the base microphone signal and/or to provide the audio output signal to the loudspeaker 25 in dependence on the earphone audio signal received from the audio communication network 30. The base station 21 may thus operate as an audio communication device in itself, e.g. when the headset 1 is docked or switched off. In some embodiments, the base station 21 may be adapted to operate as an audio communication device completely without a headset 1; in such embodiments, the cradle 22 and the headset interface unit 26 may be omitted from the base station 21.

The control unit 28 may be adapted to control the display unit 24 to show visual information messages, e.g. in response to receiving status messages from the headset 1, such as e.g. headset battery charge level and/or control commands, in response to receiving messages from the audio communication network 30, such as e.g. a notification of an incoming call, and/or in response to receiving user input on the touch screen of the display unit 24. Similarly, the control unit 28 may be adapted to control the loudspeaker 25 to emit audio information messages, such as e.g. spoken messages and/or signal tones, e.g. in response to receiving messages from the headset 1, the audio communication network 30 and/or the touch screen.

In some embodiments, the base station 21 may consist of or comprise e.g. a mobile phone, a desktop computer, a laptop computer or a tablet computer, and built-in microphones, display units, loudspeakers, headset interfaces, network interfaces and/or central processing units (CPU) of such devices may serve as corresponding units 23, 24, 25, 26, 27, 28 of the base station 21. Any such device may be comprised in an audio communication device with a headset 1 or, alternatively, be comprised in an audio communication device without a headset 1.

In some embodiments, the cradle 22 may be absent. In some embodiments, the electrical connectors 29 may be replaced with an inductive or capacitive transmitter for charging the headset 1, and the headset 1 may comprise a corresponding receiver for receiving the charging power and charge an accumulator (not shown) also comprised by the headset 1. In some embodiments, the display unit 24 and/or the loudspeaker 25 may be absent.

Figure 3:
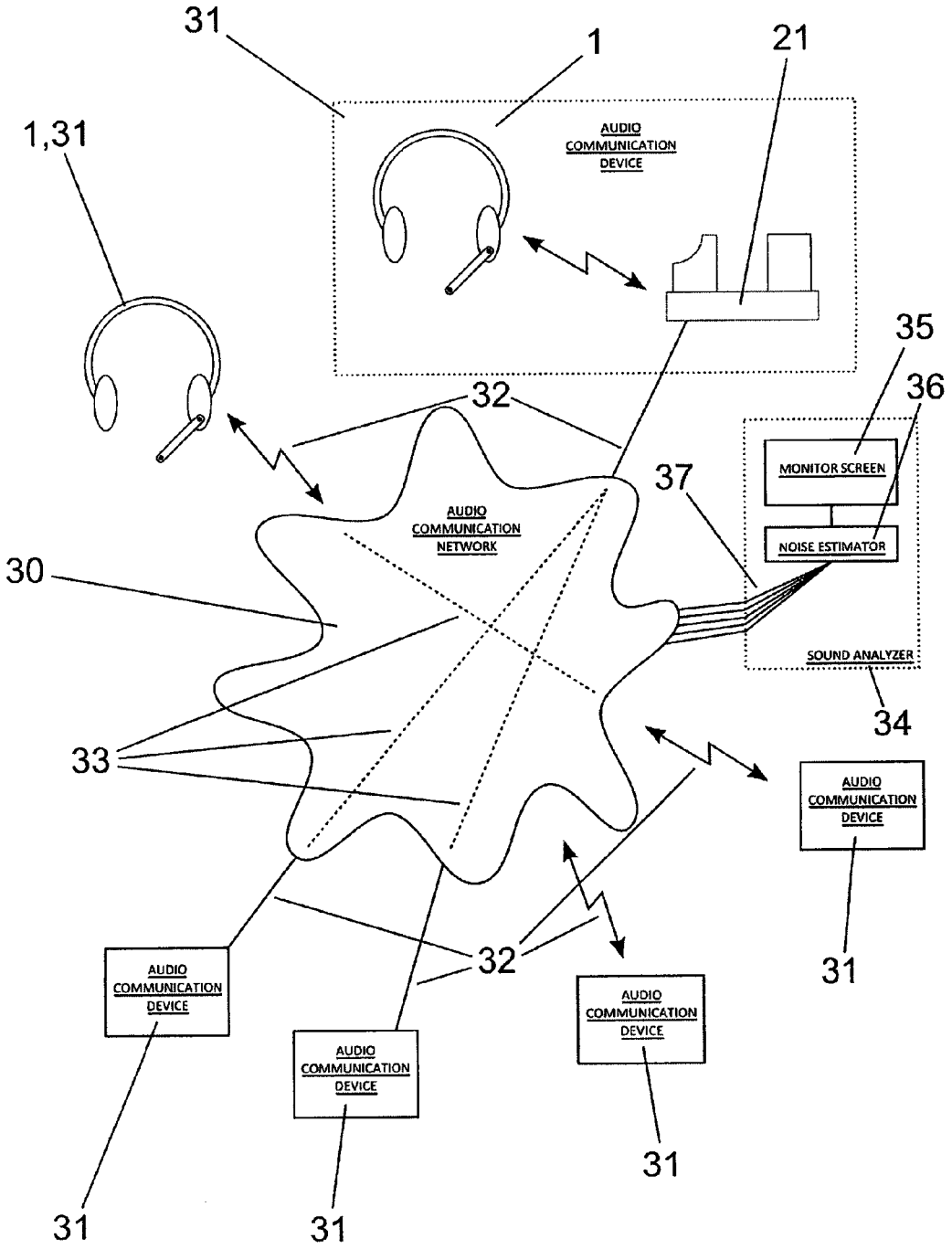
FIG. 3 shows a first embodiment of an audio communication system according to the invention.

In the audio communication system shown in FIG. 3, an audio communication network 30 is connected to a first audio communication device 31 consisting of a headset 1 as shown in FIG. 1 and described above, to a second audio communication device 31 comprising a headset 1 and a base station 21 as shown in FIG. 2 and described above as well as to a number of further audio communication devices 31, any of which may consist of or comprise e.g. a further headset 1, a further audio communication device with a headset 1 and a base station 21, a further base station 21, a mobile phone, a desktop computer, a laptop computer or a tablet computer. The audio communication devices 1, 21, 31 may be connected to the audio communication network 30 via wired or wireless party connections 32 as described further above. The audio communication network 30 comprises one or more communication channels 33, each connecting at least two audio communication devices 1, 21, 31 with each other, such that the connected audio communication devices 1, 21, 31 may exchange audio signals with each other via the audio communication network 30 and the respective party connections 32. Each communication channel 33 provides an earphone audio signal to a connected audio communication device 1, 21, 31 in dependence on respective voice audio signals received from one or more other of the connected audio communication devices 1, 21, 31. Each communication channel 33 may apply any known signal processing to the respective voice audio signals, such as e.g. amplification, frequent filtering, noise reduction and echo cancelling.

A sound analyzer 34 with a monitor screen 35, a noise estimator 36 and two or more noise inputs 37 is connected to the audio communication network 30. The audio communication network 30 further comprises two or more noise channels (not shown), each connecting a voice audio signal from an audio communication device 1, 21, 31 to a respective noise input 37 of the sound analyzer 34. The noise channels of the audio communication network 30 may e.g. be special connections that are not used for other communication, or they may e.g. be switchable to serve as noise channels at some times and as communication channels 33 at other times. The noise estimator 36 is preferably connected to receive the voice audio signals via the respective noise inputs 37 and adapted to repeatedly estimate a local acoustic noise level for each of two or more audio communication devices 1, 21, 31 in dependence on the respective received voice audio signal. The noise estimator 36 is further preferably adapted to repeatedly estimate a location-dependent distribution of acoustic noise levels in ambient space in dependence on the local acoustic noise levels. The noise estimator 36 is preferably further adapted to provide the estimated location-dependent distribution of acoustic noise levels to the monitor screen 35 for displaying. The monitor screen 35 is preferably placed e.g. on a wall in a room where the audio communication devices 1, 21, 31 are being used, so that the displayed location-dependent distribution of acoustic noise levels may serve as visual feedback to the users of the audio communication devices 1, 21, 31.

In some audio communication devices 1, 21, 31, the microphone or microphones 5, 7, 23 may be located very close to the user's mouth. Accordingly, the voice of the user will be picked up at a much higher level than the voices of other persons in the vicinity of the device 1, 21, 31. In order to avoid that this effect causes disproportionate variations in the estimated location-dependent distribution of acoustic noise levels, one or more audio communication devices 1, 21, 31 may each comprise a voice activity detector (not shown) adapted to detect whether the user of the respective audio communication device 1, 21, 31 is speaking and to provide a corresponding voice activity signal to the noise estimator 36. Alternatively, the voice activity detector may be comprised by the noise estimator 36 and may be adapted to provide the voice activity signal in dependence on the voice audio signal received from the respective audio communication device 1, 21, 31. The noise estimator 36 may be adapted to temporarily lower the estimated local acoustic noise level for those audio communication devices 1, 21, 31 for which the voice activity signal indicates that the user is speaking. Alternatively, the noise estimator 36 may temporarily reduce the influence from the respective microphone output signal on the location-dependent distribution of acoustic noise levels in other suitable ways, e.g. by temporarily reducing a weighting of the respective local acoustic noise levels in the estimation of the location-dependent distribution of acoustic noise levels.

The audio communication network 30 may be adapted to transfer messages, such as e.g. status messages, between the audio communications devices 1, 21, 31, the sound analyzer 34 and/or the noise estimator 36 connected to the audio communication network 30. Such messages may include e.g. noise level messages as described further below and/or voice activity signals.

In some embodiments, the first audio communication device 1, 31 may be absent. In some embodiments, the second audio communication device 31, 1, 21 may be absent. In some embodiments, the monitor screen 35 and the noise estimator 36 may be comprised by physically separate devices connected by an appropriate wired or wireless connection, either directly or indirectly, e.g. via the audio communication network 30.

Figure 4:
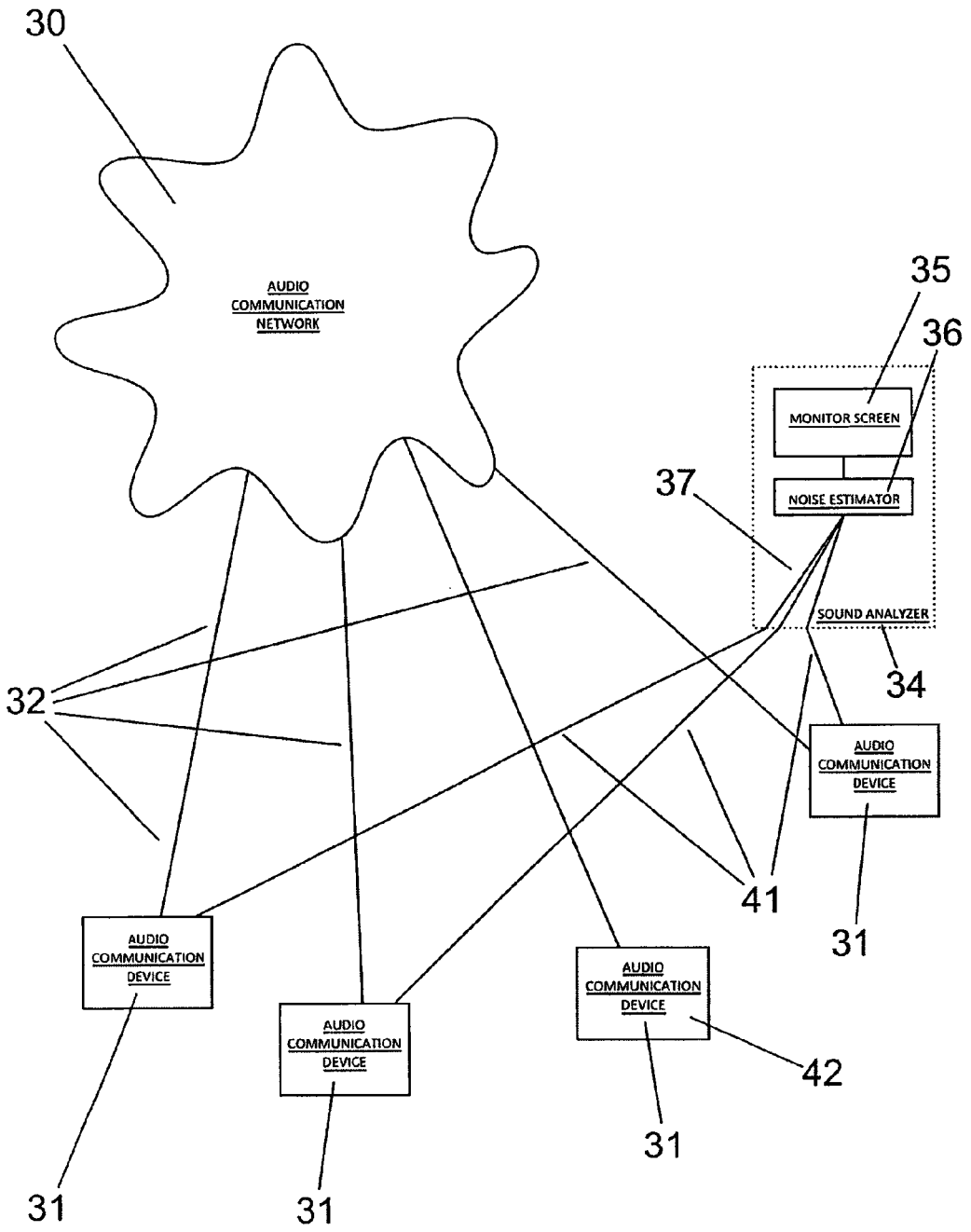
FIG. 4 shows a second embodiment of an audio communication system according to the invention.

The audio communication system shown in FIG. 4 is similar to the audio communication system shown in FIG. 3 and functions in a similar way, however with the differences described in the following. Again, an audio communication network 30 is connected to a number of audio communication devices 31 via respective wired or wireless party connections 32. The noise inputs 37 of the sound analyzer 34 are connected to the audio communication devices 31, however, not via the audio communication network 30 but instead via respective wired or wireless noise signal connections 41. One of the audio communication devices 42 is not connected to the sound analyzer 34, and the audio communication system may possibly comprise further audio communication devices 42 that are connected to the audio communication network 30 but not to the sound analyzer 34.

Apart from the audio communication device 42, each audio communication device 31 is adapted to provide a noise signal in dependence on a microphone signal to the sound analyzer 34 via the respective noise signal connection 41 in dependence on a microphone output signal from a microphone 5, 7, 23 comprised by the audio communication device 31. The noise estimator 36 is preferably adapted to repeatedly estimate a local acoustic noise level for each of two or more audio communication devices 31 in dependence on the noise signal received on the respective noise input 37. The noise estimator 36 is further preferably adapted to estimate a location-dependent distribution of acoustic noise levels in ambient space as described further above for FIG. 3.

Figure 5:
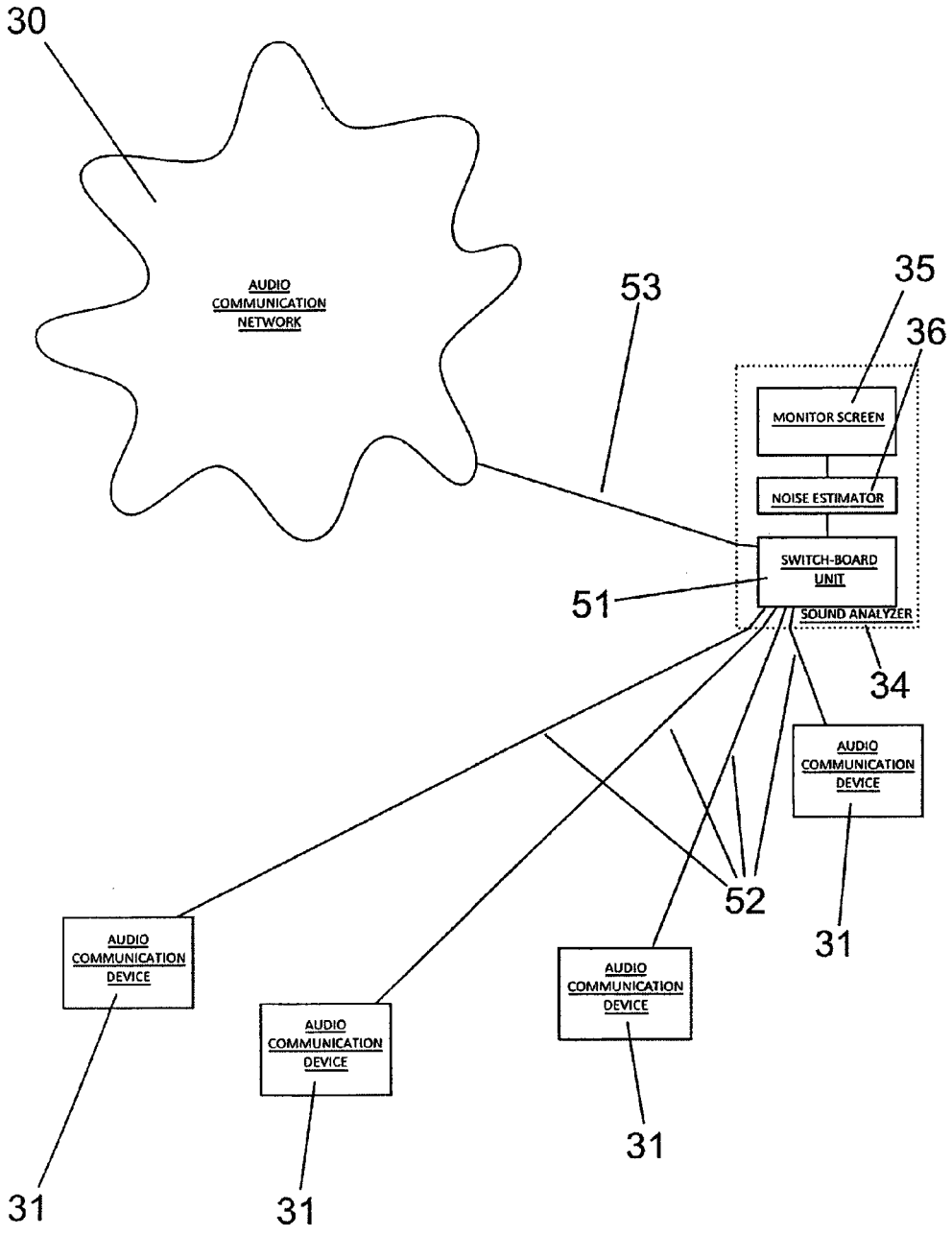
FIG. 5 shows a third embodiment of an audio communication system according to the invention.

The audio communication system shown in FIG. 5 is similar to the audio communication system shown in FIG. 4 and functions in a similar way, however with the differences described in the following. In FIG. 5, direct party connections 32 between the audio communication network 30 and the audio communication devices 31 are absent. Instead, the sound analyzer 34 further comprises a switch-board unit 51 connected to the audio communication devices 31 via respective local party connections 52 and to the audio communication network 30 via a switch-board connection 53.

The switch-board unit 51 is adapted to function as a switch board as already known in the art, which connects the audio communication devices 31 with each other and/or with the audio communication network 30. The switch-board unit 51 may e.g. comprise an IP telephony server or any other known type of audio communication switch board. The switch-board unit 51 may preferably be implemented as a digital switch board allowing the audio communication devices 31 to exchange audio signals and status messages with each other, with the switch-board unit 51 itself and/or with the noise estimator 36.

Each audio communication device 31 is preferably adapted to provide a noise signal to the sound analyzer 34 via the respective local party connection 52 in dependence on a microphone output signal from a microphone 5, 7, 23 comprised by the audio communication device 31. The switch-board unit 51 is preferably adapted to forward the noise signals to the noise estimator 36. The noise estimator 36 is preferably adapted to repeatedly estimate a local acoustic noise level for each of two or more audio communication devices 31 in dependence on the respective noise signal received from the switch-board unit 51. The noise estimator 36 is further preferably adapted to estimate a location-dependent distribution of acoustic noise levels in ambient space as described further above for FIG. 3.

In some embodiments, the monitor screen 35, the noise estimator 36 and the switch-board unit 51 may—in any appropriate combination—be comprised by two or more physically separate devices connected by appropriate wired or wireless connections, either directly or indirectly, e.g. via the switch-board unit 51 and/or via the audio communication network 30.

In some embodiments, two or more audio communication devices 31, such as e.g. a headset 1 or a headset 1 with a base station 21, may engage in a wired or wireless ad hoc network (not shown), such as e.g. a WiFi Direct network, and some or all of the wireless connections to and/or from these audio communication devices 31 may go at least partly through the ad hoc network.

Figure 6:
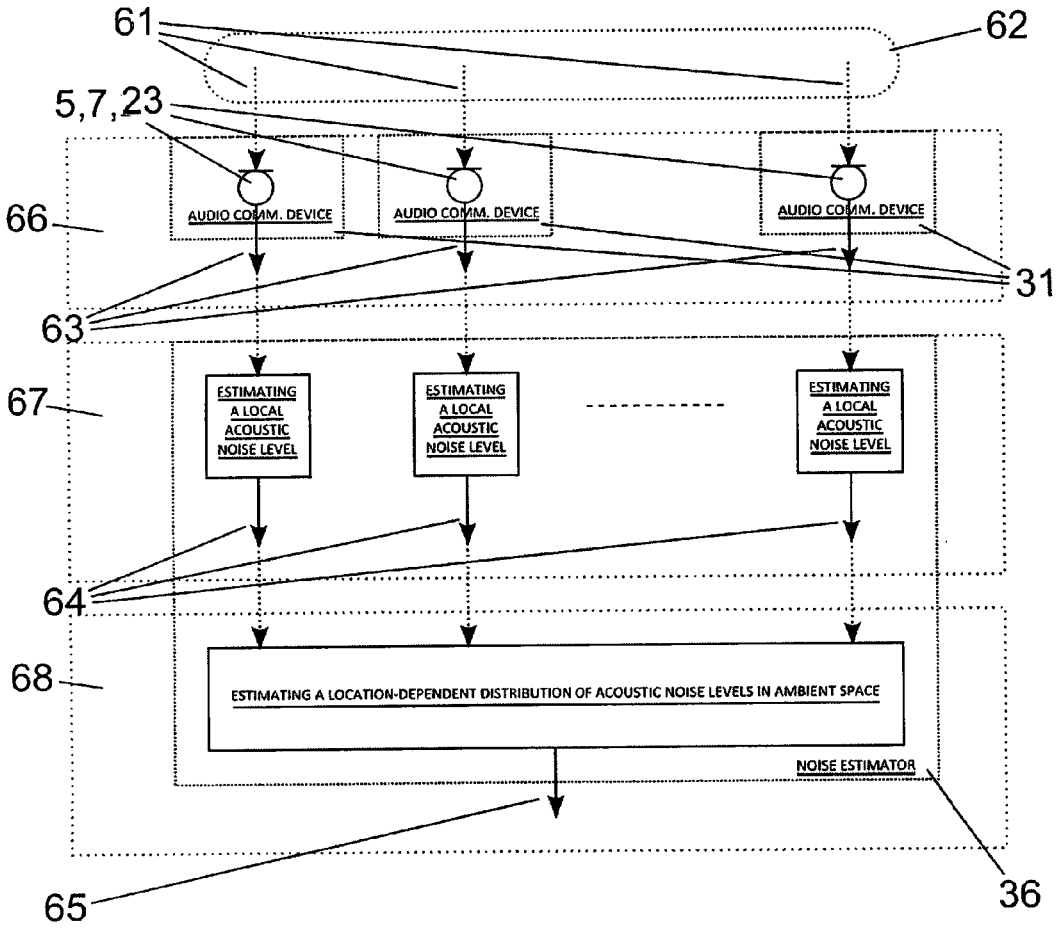
FIG. 6 shows a first embodiment of a method according to the invention.

The method shown in FIG. 6 comprises: for each of two or more audio communication devices 31, receiving an acoustic signal 61 from ambient space 62 and providing a corresponding microphone output signal 63 by a microphone 5, 7, 23 comprised by the respective audio communication device 31 and repeatedly estimating a local acoustic noise level 64 in dependence on the microphone output signal 63; and repeatedly estimating a location-dependent distribution of acoustic noise levels in ambient space 62 in dependence on the local acoustic noise levels 64.

A first part 66 of the method, namely receiving the acoustic signal 61 and providing the corresponding microphone output signal 63, is obviously executed by the respective audio communication device 31. A second part 67 of the method, namely repeatedly estimating the local acoustic noise level 64, may be executed by a noise estimator 36 as described further above for FIGS. 3, 4 and 5. A third part 68 of the method, namely repeatedly estimating a location-dependent distribution of acoustic noise levels 65, may preferably be executed by the noise estimator 36.

Figure 7:
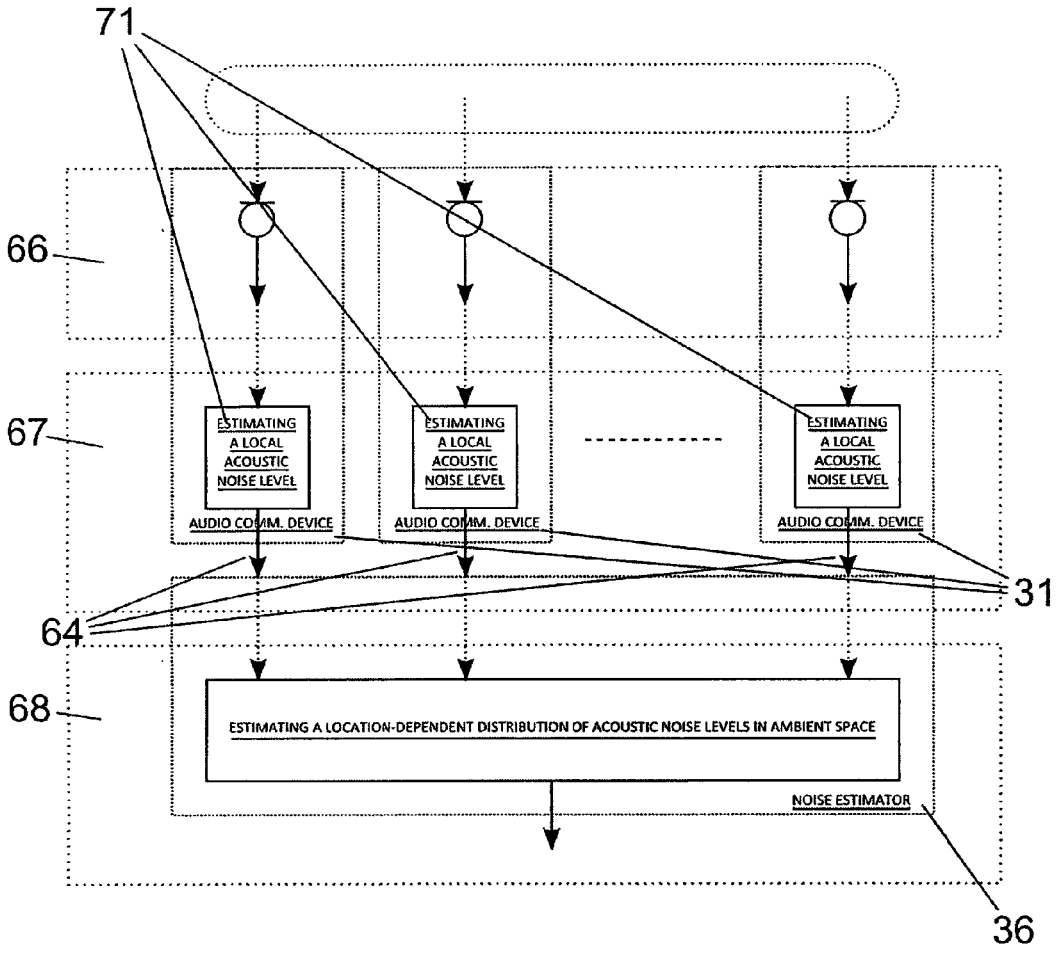
FIG. 7 shows a second embodiment of a method according to the invention.

The method shown in FIG. 7 is similar to the method shown in FIG. 6, however with a different distribution of the execution of parts 66, 67, 68 of the method. Here, both the first part 66 and the second part 67 of the method are executed by the respective audio communication devices 31.

Thus, any of the audio communication devices 31 may comprise a noise level estimator 71 adapted to repeatedly estimate the local acoustic noise level 64 in dependence on the microphone output signal 63 as well as an interface unit 11 or a network interface unit 27 as described further above for FIG. 1 and FIG. 2, which is further adapted to provide a local noise level signal to the audio communication network 30, e.g. as status messages, via a party connection 32. The interface unit 11, 27 may alternatively provide the local noise level signal to a switch-board unit 51 via a local party connection 52. The third part 68 of the method is executed by a noise estimator 36 which is connected to two or more of the audio communication devices 31, preferably via the audio communication network 30, via a party connection 32 and/or via the switch-board unit 51. The noise estimator 36 is adapted to repeatedly estimate a location-dependent distribution of acoustic noise levels in ambient space 65 in dependence on the local noise level signals—and thus also in dependence on the local acoustic noise levels 64.

In audio communication devices 31 comprising a headset 1 without a base station 21, e.g. as shown in FIG. 1, the noise level estimator 71 may preferably be comprised by the signal processing unit 10 of the headset 1. In audio communication devices 31 comprising a headset 1 and a base station 21, e.g. as shown in FIG. 2, the noise level estimator 71 may be comprised by the signal processing unit 10 of the headset 1 or by the control unit 28 of the base station 21. In other types of audio communication devices 31, the noise level estimator 71 may be comprised by e.g. a CPU or another suitable signal processing device comprised by the respective audio communication device 31. In the method shown in FIG. 6, one or more noise level estimators 71 may be comprised by the noise estimator 36.

Figure 8:
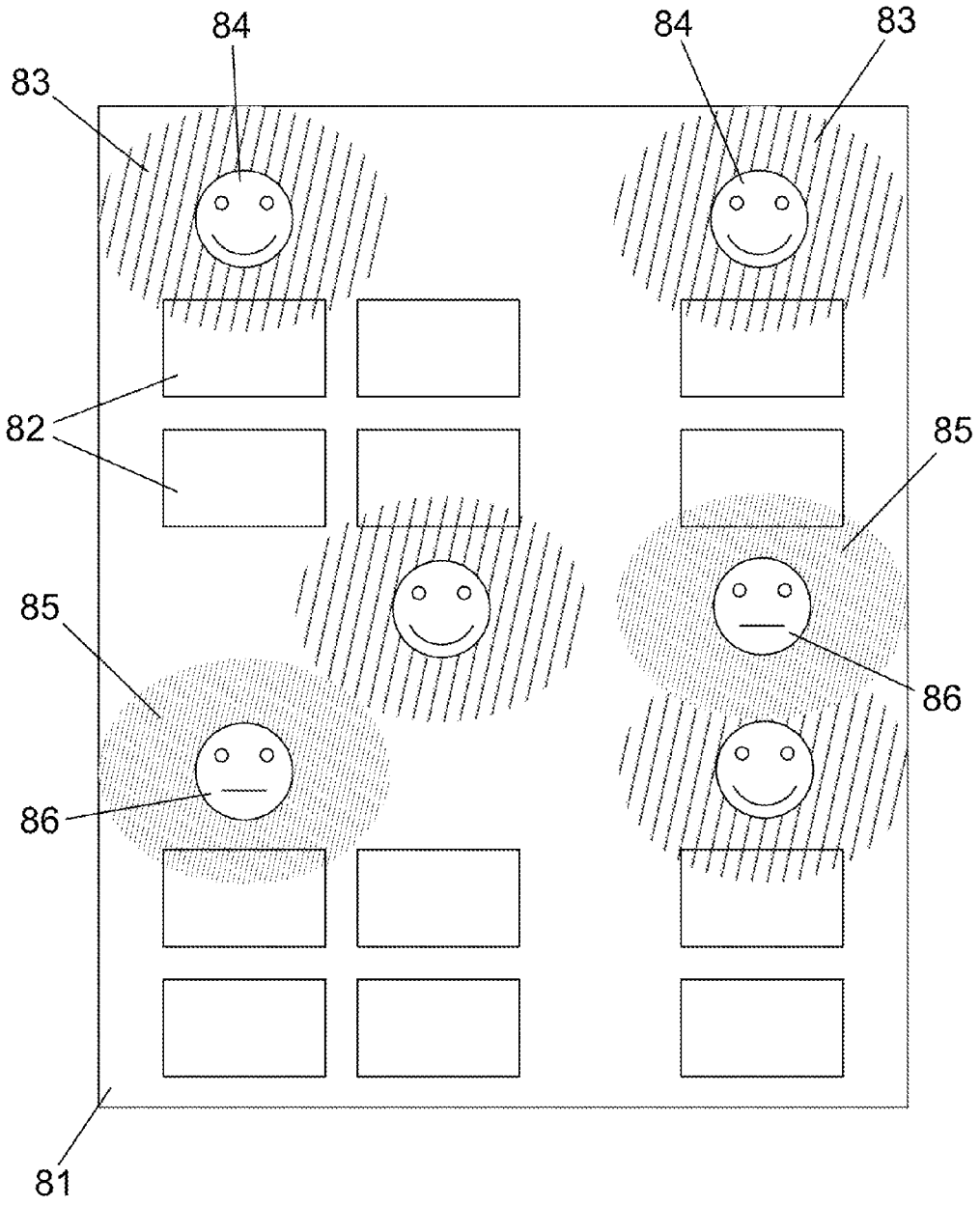
FIG. 8 shows an example of visual feedback provided by an embodiment of a method or a system according to the invention.

The picture 81 shown in FIG. 8 is an example of how visual feedback to one or more users of audio communication devices 31 may be presented. The picture 81 comprises a simplified map of an office room with a number of rectangles 82 indicating the position of desks or work stations in the room. Next to some of the rectangles 82, green-colored areas 83 (in the figure, the green color is indicated by coarse hatching) are shown indicating that in the corresponding parts of the room, the acoustic noise level is below a predefined noise threshold. At the presumed location of the respective device users, a green-colored smiling-face icon 84 with a smile is shown, indicating that the respective user is not speaking so loud that the predefined noise threshold could be exceeded. Next to other of the rectangles 82, red-colored areas 85 (the red color is indicated by fine hatching) are shown indicating that in the corresponding parts of the room, the acoustic noise level 64 is above the predefined noise threshold. At the presumed location of the respective device users, a red-colored disapproving-face icon 86 is shown, indicating that the respective user is speaking so loud that the predefined noise threshold is exceeded. The coloring of each of the areas 83, 85 serves as a visual indication of a slowly averaged acoustic noise level in corresponding a portion of the room, while the coloring and/or mimic of each of the face icons 84, 86 serve as a visual indication of an instant or quickly averaged acoustic noise level at a corresponding position in the room.

In some embodiments, one or more of the areas 83, 85 may each cover more than one desk or work station. In some embodiments, the noise estimator 36 determines the slowly averaged acoustic noise levels in dependence on the estimated location-dependent distribution of acoustic noise levels in ambient space 65 using time constants in the range between 5 and 60 min, more preferably between 10 and 30 min. In some embodiments, the noise estimator 36 determines the instant or quickly averaged acoustic noise levels in dependence on the estimated location-dependent distribution of acoustic noise levels in ambient space 65 using time constants in the range below 10 min, more preferably below 5 min or even below 1 min. In some embodiments, one or more of the instant or quickly averaged acoustic noise levels is determined in dependence on a voice audio signal and/or a microphone signal 63 provided by an audio communication device 31 using time constants in the range below 5 min, more preferably below 1 min. Determining an instant or quickly averaged acoustic noise level in dependence on a voice audio signal and/or a microphone signal 63 provided by an audio communication device 31 may preferably be executed by e.g. a signal processing unit 10 of a headset 1 or by a control unit 28 of a base station 21. In some embodiments, one or more of the instant or quickly averaged acoustic noise levels is determined using a shorter time constant for rising noise levels, e.g. below 30 s or below 10 s, than the time constant for falling noise levels, which may e.g. be chosen within the range 1 min to 5 min.

A feedback controller (not shown) preferably determines the coloring of the areas 83, 85 as well as the coloring and/or mimic of the face icons 84, 86 in dependence on respectively the slowly averaged and the instant or quickly averaged acoustic noise levels, and the feedback controller preferably repeatedly updates the picture 81 when the respective acoustic noise levels change and/or when a noise threshold changes. The feedback controller is preferably comprised by the noise estimator 36 and provides a video feedback signal to the monitor screen 35 described above so that the monitor screen 35 may display the picture 81. Alternatively, or additionally, one or more base stations 21 may each comprise a feedback controller, e.g. comprised by the control unit 28, adapted to generate and provide the video feedback signal to the display unit 24 of the respective base station 21 so that the display unit 24 may display the picture 81 or a portion hereof; in this case, the noise estimator 36 preferably provides the slowly averaged acoustic noise levels and/or the instant or quickly averaged acoustic noise levels to the respective base station 21, e.g. as signals or messages via the audio communication network 30 and the respective party connection 32, via the respective noise signal connection 41 or via the switch-board unit 51 and the respective local party connection 52.

In some embodiments, the feedback controller may, in addition to, or instead of, generating and providing a video feedback signal to a monitor screen 35 or a display unit 24, directly or indirectly provide an audio feedback signal to an acoustic output transducer, e.g. a conventional loudspeaker arranged in the room, a loudspeaker 25 of a base station 21 or a driver 9 of a headset 1, such that the acoustic output transducer 25, 9 may emit an acoustic feedback signal indicating when the respective local acoustic noise level, or the respective instant or quickly averaged acoustic noise level, exceeds a noise level threshold. The acoustic feedback signal may comprise e.g. a constant or intermittent signal tone or a spoken message. Additionally, or alternatively, the feedback controller may provide a similar vibration feedback signal to a transducer (not shown), such as a vibrator adapted to provide a tactile feedback signal to a wearer of a headset 1 or a user of another audio communication device 31.

The noise estimator 36 may comprise individual noise level thresholds for the video, audio and/or vibration feedback signal and/or for the slow and instant or quickly averaged acoustic noise levels. The noise estimator 36 may control one or more noise level thresholds in dependence on the location of one or more audio communication devices 31 and/or on time, e.g. in dependence on thresholds entered e.g. in a schedule and/or a map by an administrator or another user on a computer connected to the audio communication system.

The noise estimator 36 may comprise a position storage (not shown) for storing device positions for two or more of the audio communication devices 31 in the audio communication system, and the noise estimator 36 may preferably be adapted to estimate the location-dependent distribution of acoustic noise levels in ambient space in dependence on device positions retrieved from the position storage. The device positions may e.g. be entered by an administrator or another user on a computer connected to the audio communication system. Alternatively, or additionally, one or more of the audio communication devices 31 may comprise a positioning device (not shown), e.g. a GPS receiver or the like, adapted to estimate the position of the respective audio communication device 31 and to provide a corresponding position signal, and the respective audio communication device 31 may be adapted to provide the position signal to the noise estimator 36, preferably together with, in a similar way and/or via the same connections as the voice audio signal and/or the noise level signal. The noise estimator 36 is preferably adapted to receive the position signals and to update the device positions in the position storage accordingly.

The noise estimator 36 may comprise a position estimator (not shown) adapted to estimate the relative positions of two or more of the audio communication devices 31 in the audio communication system. The position estimator may preferably estimate the relative positions in dependence on noise signals received from two or more audio communication devices 31. The position estimator may preferably determine the correlation over time between local acoustic noise levels 64 for two or more of the audio communication devices 31, estimate one or more distances between the two or more of the audio communication devices 31 in dependence on the determined correlation and estimate the relative positions in dependence on the estimated distances. The position estimator may thus utilize the effect that noise level correlation generally increases with decreasing distance between microphones 5, 7, 23. Methods for determining a relative map of locations from known distances between the locations are known in the art, and any such method may be implemented in the position estimator. The noise estimator 36 is preferably adapted to update one or more device positions in the position storage in dependence on positions estimated by the position estimator.

In some embodiments, one or more of the audio communication devices 31 may each comprise a ranging unit (not shown) adapted to determine a distance to at least one other audio communication device 31. The ranging unit may e.g. be adapted to determine the distance by determining the time delay of an acoustic signal travelling between the respective two audio communication devices 31. Acoustic ranging methods and systems are known in the art, and any such method may be implemented in the ranging unit. In some embodiments, ranging units of two or more of the audio communication devices 31 may be adapted to cooperate to determine the distance between the respective audio communication devices 31, e.g. in that one of the ranging units transmits an acoustic ranging signal and the respective other ranging units determine the propagation delay of the acoustic ranging signal. Each of the ranging units is preferably adapted to transmit acoustic ranging signals only when e.g. a headset 1 is not being worn or when it otherwise determines that no user is proximate the respective audio communication device 31.

The noise estimator 36 may be adapted to determine when a headset 1 or another body-worn audio communication device 31 moves within the room and to update the device position of the respective microphone 5, 7, 23 in the position storage accordingly. The feedback controller may be adapted to update visual, acoustic and/or tactile feedback based on the new device position. The noise estimator 36 may further be adapted to alter a noise level threshold for a headset 1 or another body-worn audio communication device 31 in dependence on detecting that the respective headset 1 or other body-worn audio communication device 31 moves into a portion of the room for which another noise level threshold has been set.

The audio communication device 31 and/or the noise estimator 36 may apply frequency- and/or level-dependent filtering to the noise signals 63 and/or noise level signals 64 e.g. to adapt the signals to the normal loudness perception and/or to avoid including known, steady noise sources in the location-dependent distribution of acoustic noise levels 65. Such filtering may e.g. be made using the commonly used A-weighting and/or standard loudness curves.

The noise level estimator 71 may estimate the acoustic noise levels individually for two or more frequency ranges and provide the noise level signal as a frequency-dependent signal. Similarly, the noise estimator 36 may estimate the location-dependent distribution of acoustic noise levels 65 as a frequency-dependent distribution. The noise estimator 36 may apply individual noise level thresholds for different frequency ranges, and the thresholds may thus be frequency-dependent. Correspondingly, the audio communication device 31, the noise estimator 36 and/or the noise level estimator 71 may provide a frequency-dependent noise signal and/or noise level signal for an audio communication device 31 to one or more other audio communication devices, e.g. via the connections described further above.

An audio communication device 31 receiving a frequency-dependent noise signal and/or noise level signal may be adapted to apply a time- and frequency-dependent filtering to the voice audio signal provided to the audio communication network 30 in dependence on the received frequency-dependent noise signal and/or noise level signal. Alternatively, or additionally, the audio communication device 31 may apply such filtering to the earphone audio signal provided to the drivers 9 and/or loudspeaker 25. Thus, an audio communication device 31 may apply noise reduction to the signals picked up from or presented to the user of the respective device 31 based on noise signals or noise spectra determined by an audio communication device 31 located close by, e.g. in the same room. An audio communication device 31 may e.g. use the received frequency-dependent noise signal and/or noise level signal to apply e.g. active noise cancelling or Wiener-filtering to the voice audio signal and/or the earphone audio signal.

For example, the present disclosure may be used for enhanced noise cancelling. Each of the communications device 31 preferably have ambient noise microphones. If a noise source is located in one area of a space, then the closest microphone will have the greatest clarity of the noise source, that is, it will have the strongest signal to identify and distinguish noise from desirable sounds. Microphones, headsets, or base stations located more distant from the strongest signal source will detect the noise at a lower amplitude and thus, differentiation of the noise signal at these more distance pickup points will be more difficult. In the present disclosure, the signature (pattern of sounds, typically cyclical) of the noise source is determined from data received from the pickup (microphone, headset, base station, etc.) which receives the clearest noise signal. The clearest signal may be the highest amplitude, highest signal to noise ratio, or other know basis for determining the best microphone to be used to determine the noise signature. With the signature known, it can be transmitted to other devices in the space subject to this noise, and the noise can be subtracted or otherwise removed/diminished from the sounds picked up by other devices elsewhere in the space, which have less clarity/differentiation between noise and desirable sounds. The noise signature is then applied to the output of other devices, such as by 180 degree phase reversal, or other known noise suppression methods. By such method, even devices located distant from the noise source obtain benefit from the device with great clarify of noise signature.

The noise estimator 36 and/or an audio communication device 31 may further be adapted to determine the spectral contents of one or more received frequency-dependent noise signals and/or noise level signals and to identify a noise source or a type of noise source in dependence on the determined spectral contents. The noise estimator 36 may be adapted to provide an indication of the determined spectral contents, an identified noise source and/or an identified type of noise source to one or more of the audio communication devices 31. An audio communication device 31 may be adapted to modify any time- and frequency-dependent filtering applied to the voice audio signal and/or the earphone audio signal in dependence on the determined spectral contents, the identified noise source and/or the identified type of noise source. Alternatively, or additionally, the noise estimator 36 may modify one or more noise thresholds, and/or e.g. time constants used for determining the slowly averaged acoustic noise levels and/or the instant or quickly averaged acoustic noise levels.

One or more of the audio communication devices 31 may each comprise one or more sensors adapted to sense respective further ambience parameters, such as e.g. air temperature, air pressure, carbon dioxide level, light level, light spectrum or humidity, respective device parameters, such as e.g. altitude or orientation of the device 31, and/or respective physiological parameters, such as e.g. body temperature or heart rate of the user, and may be adapted to provide corresponding sensor signals and to provide such sensor signals to the noise estimator 36. The noise estimator 36 may use such parameters to give more detailed feedback to the users about the environment and/or to monitor the environment and/or the users of the audio communication devices 31 for indications of stress as well as otherwise unhealthy or even dangerous conditions and to provide corresponding feedback or warnings to a user or a supervisor.

Advantageous embodiments of methods according to the invention may include a method for estimating acoustic noise levels, the method comprising: 66 for each of two or more audio communication devices 1, 21, 31, receiving an acoustic signal 61 from ambient space 62 and 67 providing a corresponding microphone output signal 63 by a microphone 5, 7, 23 comprised by the respective audio communication device 1, 21, 31 and 67 repeatedly estimating a local acoustic noise level 64 in dependence on the microphone output signal 63; and 68 repeatedly estimating a location-dependent distribution of acoustic noise levels in ambient space 65 in dependence on the local acoustic noise levels 64.

Advantageously, the method further comprises: by at least one of said two or more audio communication devices 1, 21, 31, providing an audio input signal to an audio communication network 30 in dependence on the microphone output signal 63.

Advantageously, the method further comprises: by at least one of said two or more audio communication devices 1, 21, 31, detecting whether the user of the respective audio communication device 1, 21, 31 is speaking and providing a corresponding voice activity signal; estimating the location-dependent distribution of acoustic noise levels 65 further in dependence on the voice activity signal, such that the influence from said microphone output signal 63 is temporarily reduced when the voice activity signal indicates that the user is speaking.

Advantageously, the method further comprises: providing visual, acoustic and/or tactile feedback 81 to at least one user of one of said two or more audio communication devices 1, 21, 31 in dependence on the estimated location-dependent distribution of acoustic noise levels 65 and on a predetermined noise level threshold.

Advantageously, the method further comprises: determining the noise level threshold in dependence on time and/or on the estimated location-dependent distribution of acoustic noise levels 65.

Advantageously, at least one of the local acoustic noise levels 64 is estimated by the respective audio communication device 1, 21, 31.

Advantageously, the visual, acoustic and/or tactile feedback 81 is provided by the respective audio communication device 1, 21, 31.

Advantageously, the method further comprises: automatically estimating a location of at least one of said two or more audio communication devices 1, 21, 31 and using the at least one estimated location for estimating the location-dependent distribution of acoustic noise levels 65.

Advantageously, the location of at least one of said two or more audio communication devices 1, 21, 31 is estimated in dependence on the local acoustic noise level 64 for the respective audio communication device 1, 21, 31 and the local acoustic noise level 64 for at least one other of said two or more audio communication devices 1, 21, 31.

Advantageously, the location of at least one of the audio communication devices 1, 21, 31 is estimated by the respective audio communication device 1, 21, 31.

Advantageously, the location-dependent distribution of acoustic noise levels 65 is estimated by a sound analyzer 34 connected to said two or more audio communication devices 1, 21, 31.

Advantageously, at least one of the local acoustic noise levels 64 is estimated by a sound analyzer 34 connected to said two or more audio communication devices 1, 21, 31.

Advantageously, at least one of said two or more audio communication devices 1, 21, 31 comprises a headset 1, and wherein said microphone 5, 7, 23 is comprised by the respective headset 1.

Advantageously, at least one of said two or more audio communication devices 1, 21, 31 comprises a headset 1 and a base station 21, and wherein said microphone 5, 7, 23 is comprised by the respective base station 21.

Advantageous embodiments of systems according to the invention may include a system for estimating acoustic noise levels comprising two or more audio communication devices 1, 21, 31 and adapted for performing a method according to any preceding claim.

The signal processing unit 10, the interface unit 11, the headset interface unit 26, the network interface unit 27, the control unit 28, the noise estimator 36, the switch-board unit 51, the noise level estimator 71 as well as other functional units or circuits of the audio communication system are preferably implemented as digital circuits operating on digital signals, but any portions hereof may be implemented as analog circuits operating on analog signals. Where necessary, such functional units or circuits may comprise analog-to-digital and/or digital-to-analog converters. Functional blocks of digital circuits may be implemented in hardware, firmware or software, or any combination hereof. Digital circuits may perform the functions of multiple functional blocks in parallel and/or in interleaved sequence, and functional blocks may distributed in any suitable way among multiple hardware units, such as e.g. signal processors, microcontrollers and other integrated circuits.

The detailed description given herein and the specific examples indicating preferred embodiments of the invention are intended to enable a person skilled in the art to practice the invention and should thus be seen mainly as an illustration of the invention. The person skilled in the art will be able to readily contemplate further applications of the present invention as well as advantageous changes and modifications from this description without deviating from the scope of the invention. Any such changes or modifications mentioned herein are meant to be non-limiting for the scope of the invention.

The invention is not limited to the embodiments disclosed herein, and the invention may be embodied in other ways within the subject-matter defined in the following claims. As an example, features of the described embodiments may be combined arbitrarily, e.g. in order to adapt the system, the devices and/or the method according to the invention to specific requirements.

It is further intended that the structural features of the system and/or devices disclosed herein may be combined with the methods, when appropriately substituted by a corresponding process. Embodiments of the methods generally have the same advantages as the corresponding systems and/or devices.

Any reference numerals and names in the claims are intended to be non-limiting for their scope.

The invention claimed is:

1. A method for estimating acoustic noise levels, the method comprising:

for each of two or more audio communication devices used by a user, receiving an acoustic signal from ambient space;

providing a corresponding microphone output signal by a microphone on each of said audio communications devices, and repeatedly estimating by an estimator, a local acoustic noise level in response to the microphone output signal;

repeatedly estimating by an identifier, a location-dependent distribution of acoustic noise levels in ambient space in response to the local acoustic noise levels from said audio communications devices and the locations of the audio communications devices;

providing by a signal generator, visual, acoustic, and/or tactile feedback to at least one user of an at least one of said two or more audio communication devices in response to the estimated location-dependent distribution of acoustic noise levels in the ambient space and in response to a predetermined noise level threshold in the ambient space; and wherein the at least one of said two or more audio communication devices detects whether the user of the respective audio communication device is speaking and providing a corresponding voice activity signal;

estimating the location-dependent distribution of acoustic noise levels further in response to the voice activity signal, such that the influence from said microphone output signal of an individual audio communication device is temporarily reduced when the voice activity signal indicates that that user is speaking.

2. A method according to claim 1 and further comprising: by at least one of said two or more audio communication devices, providing an audio input signal to an audio communication network in dependence on the microphone output signal.

3. A method according to claim 1 and further comprising: determining the noise level threshold in dependence on time and/or on the estimated location-dependent distribution of acoustic noise levels.

4. A method according to claim 1, wherein at least one of the local acoustic noise levels is estimated by the respective audio communication device.

5. A method according to claim 1, wherein the visual, acoustic and/or tactile feedback is provided by the respective audio communication device.

6. A method according to claim 1 further comprising: automatically estimating a location of at least one of said two or more audio communication devices and using the at least one estimated location for estimating the location-dependent distribution of acoustic noise levels.

7. A method according to claim 1, wherein the location-dependent distribution of acoustic noise levels is estimated by a sound analyzer connected to said two or more audio communication devices.

8. A method according to claim 1, wherein at least one of the local acoustic noise levels is estimated by a sound analyzer connected to said two or more audio communication devices.

9. A method according to claim 1, wherein at least one of said two or more audio communication devices comprises a headset, and wherein said microphone is comprised by the respective headset.

10. A method according to claim 1, wherein at least one of said two or more audio communication devices comprises a headset and a base station, and wherein said microphone is comprised by the respective base station.

11. A method for estimating acoustic noise levels, the method comprising:

for each of two or more audio communication devices, receiving an acoustic signal from ambient space and providing a corresponding microphone output signal by a microphone on each of said audio communications devices;

repeatedly estimating by an estimator, a local acoustic noise level in response to the microphone output signal; and repeatedly estimating by an identifier, a location-dependent distribution of acoustic noise levels in ambient space in response to the local acoustic noise levels from said audio communications devices and the locations of the audio communications devices and providing visual, acoustic, and/or tactile feedback, by a signal generator to at least one user of the audio communication devices in response to the estimated location-dependent distribution of acoustic noise levels in the ambient space on a predetermined noise level threshold in the ambient space;

automatically estimating a location of at least one of said two or more audio communication devices and using the at least one estimated location for estimating the location-dependent distribution of acoustic noise levels; and wherein the location of at least one of said two or more audio communication devices is estimated in dependence on the local acoustic noise level for the respective audio communication device and the local acoustic noise level for at least one other of said two or more audio communication devices.

12. A method according to claim 11, wherein the location of at least one of the audio communication devices is estimated by the respective audio communication device.

13. A system for estimating acoustic noise levels comprising:

a. of two or more audio communication devices used by a user, configured in an audio communications network, to receive an acoustic signal from ambient space, and transmit sound data to a server for processing;

b. each of said devices including a microphone having an output signal;

c. an estimator for repeatedly estimating a local acoustic noise level from the microphone output signal of each of said devices;

d. an identifier for repeatedly estimating a location-dependent distribution of acoustic noise levels in ambient space in response to the local acoustic noise levels measured at least by said microphones; and e. a signal generator configured to provide a visual, acoustic, and/or tactile feedback signal to at least one user of at least one of said audio communication devices in response to the location-dependent distribution of acoustic noise levels where said feedback signal is triggered when location dependent noise levels exceed a predetermined noise level threshold;

wherein the two or more audio communication devices detects whether the user of the respective audio communication device is speaking and wherein the device generates a corresponding voice activity signal;

wherein the system estimates the location-dependent distribution of acoustic noise levels further in response to the voice individual audio communication device is temporarily reduced when the voice activity signal indicates that that user is speaking.

* * * * *